United States Patent [19]

Danielson

[11] Patent Number: 4,948,148

[45] Date of Patent: Aug. 14, 1990

[54] DART GAME SCORING SYSTEM

[76] Inventor: Robert J. G. Danielson, 755 E. Virginia Way, No. 34, Barstow, Calif. 92311

[21] Appl. No.: 370,465

[22] Filed: Jun. 23, 1989

[51] Int. Cl.[5] ..... F41J 1/16

[52] U.S. Cl. ..... 273/408; 116/222; 116/325; 273/DIG. 26

[58] Field of Search ..... 273/408, DIG. 26; 116/222, 325, 326

[56] References Cited

U.S. PATENT DOCUMENTS

| | | | |
|---|---|---|---|
| 592,081 | 10/1897 | Crocker . | |
| 1,656,993 | 1/1928 | Searle . | |
| 2,794,642 | 6/1957 | O'Neill | 273/256 |
| 2,900,188 | 8/1959 | Lemon | 273/408 |
| 3,059,928 | 10/1962 | Flanagan | 273/408 |
| 3,979,117 | 9/1976 | Worsham | 273/408 |
| 4,332,386 | 6/1982 | Townsend | 273/148 A |
| 4,651,998 | 3/1987 | Holt et al. | 273/DIG. 26 X |

FOREIGN PATENT DOCUMENTS

| | | | |
|---|---|---|---|
| 1503114 | 3/1978 | United Kingdom | 273/408 |

OTHER PUBLICATIONS

"Smart Darts TM" flyer; Arachnid, Rockford, Ill.; 1 p.; no date.

*Primary Examiner*—William H. Grieb

*Attorney, Agent, or Firm*—Sheldon & Mak

[57] ABSTRACT

A scoring system for a dart game apparatus includes a target wall for mounting a dart board, a supply of at least two visually distinctive kinds of scoring markers for association with corresponding players of the game, the markers of opposing players being stackable, and a scoring panel having a modular pattern of marker positions in a plurality of array segments, each marker position being formed as a hole in the panel for releasably receiving the stem of a marker, and a pattern of score keeping indicia on the scoring panel for defining a scoring value and a required number of occurrences of the scoring value for at least one of the array segments for recording multiple required occurrences of predetermined game score increments in a first game, and for defining a scoring increment for each of at least two of the array segments, the increments being in a fixed ratio for indicating a player's score in a second game by the position of markers in the segments as a summation of the position of each marker in its segment multiplied by the scoring increment of that segment.

14 Claims, 2 Drawing Sheets

DART GAME SCORING SYSTEM

BACKGROUND

The present invention relates to game scoring systems and, more particularly to a dart game scoring system.

A variety of dart games are based on successive attempts by one or more players to propel darts for striking particular regions of a target, the regions having associated scoring values for defining progress of the game. Many such games have elaborate scoring rules, ostensibly for imparting interest and elements of strategy. However, elaborate scoring can be prohibitively difficult to keep track of.

In the game of "Cricket", for example, the object is to be the first player to hit a bull's-eye and six other numbered regions of the target three times each. In a variation of this game, it is also possible to accumulate bonus points for extra hits within the designated regions. In another game, each player begins with a predetermined number of points, such as 301, 501, etc., the object being to go "out" by scoring the same exact number of point values. Typically the target has pie-shaped regions that are numbered from 1 to 20, the regions having smaller subregions that count double or triple the designated value. Thus for each hit it is required to subtract from one's current score a value which is the product of from 1 to 3 and from 1 to 20. With such scoring complexity, some means for recording the progress of the game is a practical necessity.

One scheme is simply to keep score on paper. This is cumbersome, however, and there is often a lack of a suitable writing surface. Also, it may be difficult for each player to see what has been recorded. Another approach is to provide an electronic or computer-based display system. Although there is no limit to the capability and complexity of a computer scoring system, all such systems are expensive to produce and require some form of electrical power.

Thus there is a need for a dart game scoring system that is effective for recording and displaying the progress of a variety of dart games, that is inexpensive to produce, and is easy to use.

SUMMARY

The present invention meets this need by providing a simple mechanical dart game scoring system including, in one aspect of the invention, a supply of markers for use by players of the game; and a scoring panel having a modular pattern of marker positions on the scoring panel forming at least two distinct array segments, a pattern of score keeping indicia on the scoring panel and associated with ones of the marker positions, the indicia defining a scoring increment for each of the array segments, the increments being in a fixed ratio, and means for releasably holding one or more of the markers in association with a selected marker position, for indicating a player's score by the position of markers in the segments as a summation of the position of each marker in its segment multiplied by the scoring increment of that segment. Thus the invention proVides an easily read display of scores that does not require an excessive number of marker positions. Typically, the dart game is played with a target and a plurality of darts for shooting at selected regions of the target, each region having an associated scoring value for generating a corresponding game score value when a dart hits that region of the target.

A first array segment of the system can include a rectangular array portion having a first number of positions in one direction and a second number of positions in an orthogonal direction, the indicia defining the scoring increment in the one direction and the scoring increment multiplied by the first number in the orthogonal direction. As used herein, the term "orthogonal direction" means a direction along which the position in the one direction remains fixed. Thus a player can quickly record a new game score value by moving a marker from its old position to a new row according to the score value divided by the first number, and a new column according to the division remainder. The scoring increment of a second array segment of the marker positions is the product of the scoring increment of the first array segment, the first number of positions, and the second number of positions. The scoring increment of the first array segment is unity, the first number is five, the second number is ten, and the scoring increment of the second segment is fifty. Thus a player's marker can be moved in a column between rows as the game score value is counted by "fives". Preferably the first array segment includes a starting position having an associated indicia for a value of 51 for recording initial points of 301, 501, 701, 751, etc.

The system preferably includes at least two visually distinctive kinds of the markers for association with corresponding players of the game, at least one of the array segments being capable of receiving at least two of the kinds of markers in each position for permitting opponents' markers to simultaneously occupy a single position of the segment. The panel can be formed with an opening at each marker position, each marker having a body portion and a stem portion for engaging a selected opening of the panel, at least some of the markers having a body cavity for receiving a stem portion of another marker whereby the markers of opposing players may be stacked. In a first game, a predetermined number of occurrences of at least one of the game score values can be required for a player to win the game, the indicia defining a scoring value and a required number of occurrences of the scoring value for at least one of the array segments. The target can have a bull's-eye region and at least six other labeled regions, panel having at least seven array segments, the seven array segments having associated indicia corresponding, respectively, to the bull's-eye region and each of the six labeled regions, each of the seven array segments having at least three marker positions for recording a like number of the required occurrences.

At least some of the target regions can have at least one subregion for designating a predetermined multiple of the scoring value for that region, the multiple of the scoring value being used as the game score value in a second game, the system further including a chart of the scoring value and associated game score values for each of the regions and subregions.

The system can also include a target wall connected to the scoring panel for mounting a dart board, and means connected to the wall for stOring the markers. The means for storing the markers can include a cabinet structure of the system having opposite side members, a bottom member, and a back member that is formed by the target wall, and a panel member of the scoring panel pivotally connected to the cabinet portion. The cabinet structure can have a shelf member and a front member, the panel member being pivotally connected to the shelf member, downwardly sloping to a closed position against the front member, the target wall extending above the shelf member. Alternatively, the cabinet structure can include a pair of the panel members, each being pivotally connected to one of the side members and closing edgewise for covering the target, the marker positions and associated indicia being visible with the panel members opened outwardly.

In another aspect, the system includes the supply of markers and the scoring panel, the panel having the modular pattern of marker positions and associated indicia for the required number of occurrences of each scoring value, and the means for holding the markers for recording each required occurrence of a scoring value.

DRAWINGS

These and other features, aspects, and advantages of the present invention will become better understood with reference to the following description, appended claims, and accompanying drawings, where:

DESCRIPTION

Figure 4:
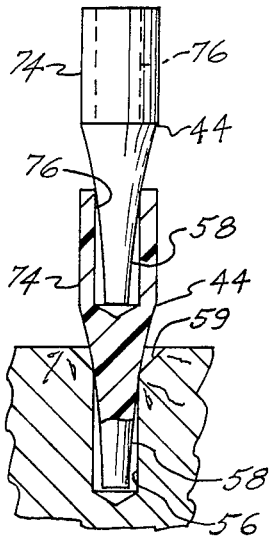
FIG. 4 is a sectional detail view of the system of FIG. 1 on line 4—4 of FIG. 3.

The present invention is directed to a simple yet versatile mechanical scoring system for dart games. With reference to FIGS. 1–4 of the drawings, a scoring system 10 includes a target wall 12 for mounting a conventional dart game target 14. The target 14, which is shown more completely in FIG. 5, has a plurality of target regions 18 including a bull's-eye region $18_B$ and twenty pie-shaped regions $18_n$ radiating therefrom, each of the pie shaped regions $18_n$ having an associated target designator for defining a corresponding scoring value when that region is struck by a player's dart 20. Each of the pie-shaped regions 18 has a doubles subregion 22 and a triples subregion 24 for defining game score values as corresponding multiples of the respective scoring values when the dart 20 hits that subregion.

Figure 1:
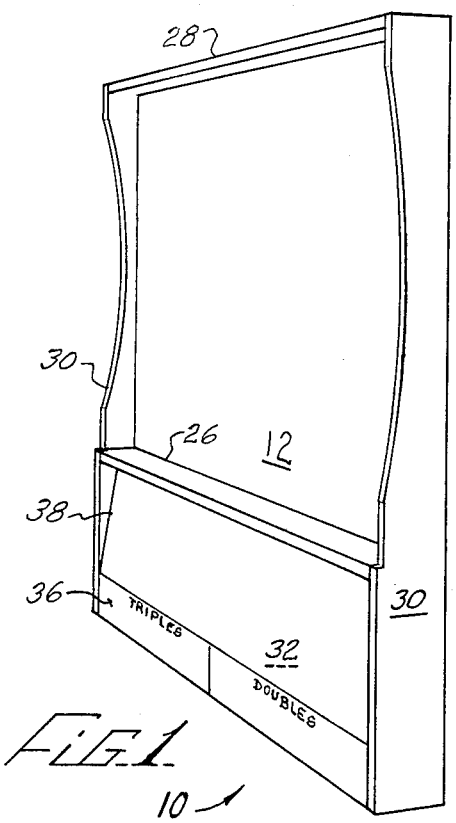
FIG. 1 is a perspective view of a dart game scoring system according to the present invention.

As best shown in FIG. 1, a shelf member 26, a top member 28, and opposite side members 30 extend forwardly from the target wall 12, the members together forming a rigid protective cavity for the target 14. A storage compartment 32 is formed below the shelf member 26 by a bottom member 34 (shown in FIG. 2), and a front member 36, in cooperation with portions of the target wall 12 and the side members 30 that extend below the shelf member 26. A scoring panel 38, further described below, is pivotally connected to the shelf member 26 by one or more hinges 40, the panel 38 having an open position as indicated by the dashed lines in FIG. 2, and a closed position in which the panel 38 slopes downwardly and forwardly from the hinge 40 into contact with the front member 26. An upstanding divider member 42 connects the target wall 12, the bottom member 34 and the front member 36 for dividing the compartment 32 between the side members 30, one side of the compartment 32 being provided for storage of the darts 20, the other side being for storing a quantity of scoring markers 44, described below.

Figure 3:
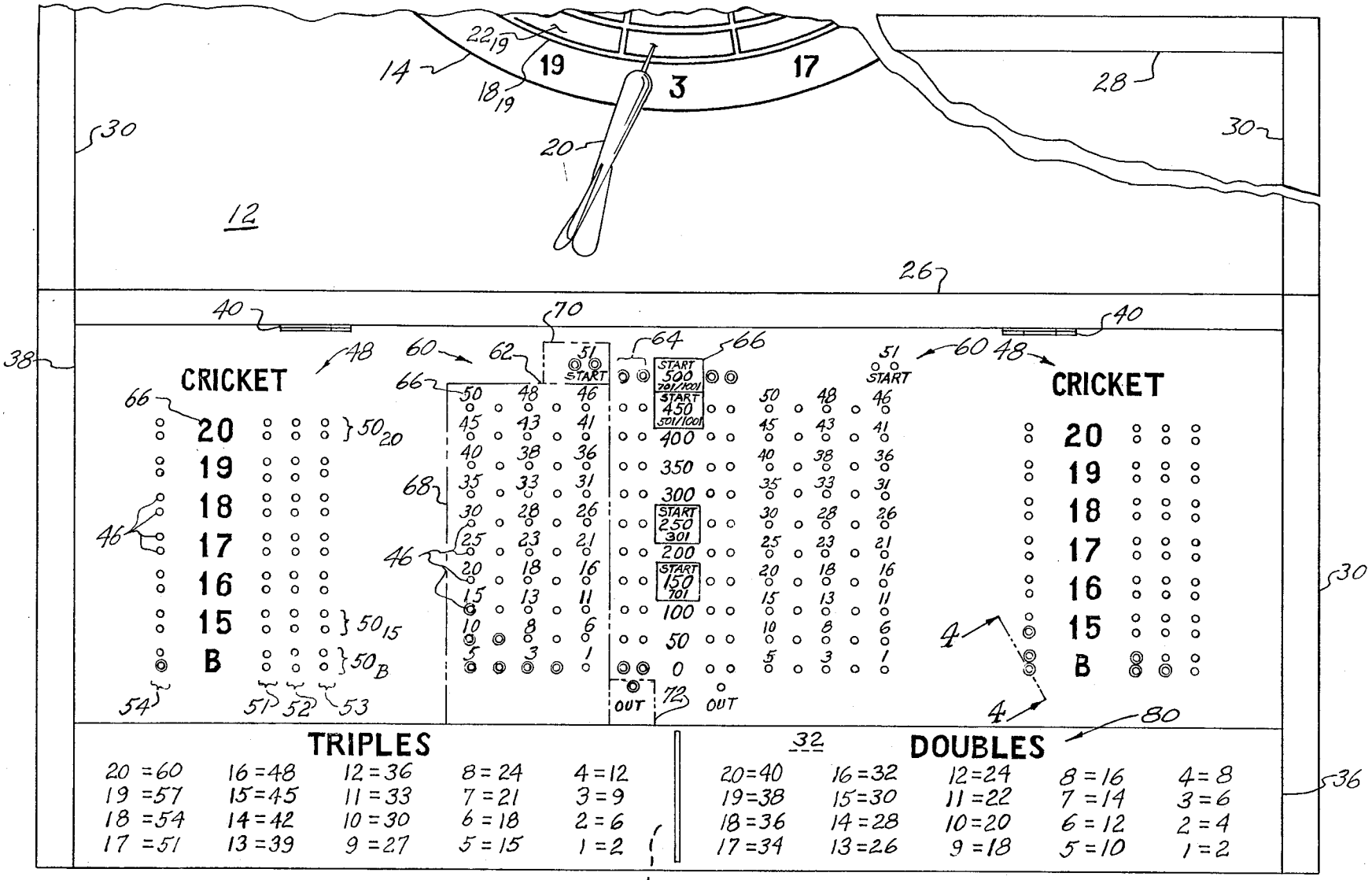
FIG. 3 is a fragmentary front detail view of the system of FIG. 1.

According to the present invention, the panel 38 has at least one array of marker positions 46 for selectively locating one or more of the markers 44, whereby the progress of a dart game may be recorded and displayed. With particular reference to FIGS. 3 and 4, the panel 38 is formed with a pair of "cricket" arrays 48 for use in scoring the game of Cricket, wherein a predetermined number of occurrences of at least one of the game score values is required for a player to win the game.

In one version of Cricket, the object is to be the first to hit the regions $18_B$ and $18_{20}$ through $18_{20}$ three times each. For scoring this game, each of the cricket arrays 48 has a plurality of array row segments 50, designated $50_B$ and $50_{15}$ through $50_{20}$, corresponding respectively to the target regions 18 that are required to be hit, each of the row segments 50 having an associated indicia that corresponds to the respective one of the target regions 18. For each of two players, the cricket array 48 has a first column 51, a second column 52, a third column 53, and a start column 54, there being a pair of the marker positions 46 at the intersection of each of the columns 51–54 with each of the row segments 50. Each of the marker positions 46 is formed as a cavity or hole 56 in the panel 38 for receiving a stem portion 58 of one of the markers 44, as shown in FIG. 4. Separate visually distinctive kinds of the markers 44 are provided by forming them in contrasting colors for the different players. Each of the marker positions 46 is formed with a countersink 59 of the hole 56, the countersink 59 serving to guide the stem portion of the marker 44 into the hole 56, the countersink 59 also being colored to match the color of the markers 44 for use by one of the players. Thus the system 10 having the pair of cricket arrays 48 and markers 44 provides a convenient way for up to four players to record and display the progress of Cricket. In another version of Cricket, further described below, bonus points are awarded, the system 10 recording and displaying the bonus points.

Another and popular dart game is called "301", in which each player has a starting point value of 301, the object being to go "out", decrementing the point value to exactly zero by a succession of game score values. Variations of this game, which are similarly named, have starting point values of 501, 701, 1001, and 1501, the games being collectively designated herein as the "301 Series" games.

For scoring the 301 Series games, the system 10 provides a pair of modular arrays 60 of the marker positions 46 on the scoring panel 38. Each of the modular arrays 60 has a first array segment 62, a second array segment 64, and a pattern of numerical indicia 66, each of the indicia 66 being associated with one of the marker positions 46 within the array 60. As best shown in FIG. 3, the first array segment 62 has a rectangular array portion 68, a start array portion 70 having a pair of the marker positions 46, and an out array portion 72, having at least one of the positions 46. The rectangular portion 68 has ten rows of five columns, providing fifty of the marker positions 46. The positions 46 within the rectangular portion 68 are numbered by the indicia 66 for defining a scoring increment of unity; beginning at the lower right of the portion 68, the odd positions 46 in the lowest row are numbered "1", "3", and "5", the corresponding column positions 46 in the succeeding rows being numbered by the indicia 66 in respective multiples of five greater than the lowermost of the positions 46 in those columns. The pair of marker positions 46 of the start array portion 70 is labeled by one of the indicia 66 as having a value of 51. Thus the first array segment 62 is capable of storing and displaying each integer value from zero ("Out") to 51 ("Start"). Moreover, the rectangular array portion 68 is capable of recording separate values for each of two or more players, even in cases of identical values, because at least some of the markers 44 are formed with a body portion 74 having a cavity 76 therein for receiving the stem portion 58 of an opponent's marker 44, whereby opponent's markers 44 may be stacked at a single marker position 46 of the rectangular array portion 68, significantly reducing the number of the holes 56 that are required to be formed in the panel 38 for a given capacity of the first array segment.

The second array segment 64 of the modular array 60 has a pair of columns of the marker positions 46 for each of two players, the positions 46 being numbered by the indicia 66 in increments of fifty (50). An important feature of the present invention is that the increments of fifty between the adjacent marker positions 46 of the second array segment 64 corresponds to both the number of the positions 46 within the rectangular array portion 68 of the associated first array segment 62, and the scoring value of the bull's-eye $18_B$. Thus the bull's-eye is scored simply by moving a marker 44 one position in the second array segment 64.

As shown in FIG. 3, there are for each player eleven of the positions 46 in the second array segment 64, the positions 46 being numbered by the indicia 66 from zero to 500. Also, the second array segments 64 of each modular array 60 are centrally located on the panel 38, on opposite sides of a single set of the indicia 66. Further, several of the indicia 66 identify the associated positions 46 as being starting locations for the games 301, 501, 701, and 1001. For example, the positions 46 having the value 250 are indicated as being starting locations for "301". In that game, a starting point value of 301 is recorded and displayed by locating one of a player's markers 44 in the start array portion 70 of the first array segment 62 (indicating a point value of 51), and another of the markers 44 in the second array segment 64 at that player's position 46 having the value 250. Alternatively, the marker 44 in the second array segment 64 is initially located at the position 46 having the value of 450 for playing "501". In the game "701", two of the markers 44 are used, at the positions 46 having the values 150 and 500, indicating, together with the marker 44 in the start array portion 70, a total starting point value of 701. Further, a starting point value of 1001 for the game "1001" is indicated by locating the two markers 44 within the second array segment 64 at the positions 46 having the values 450 and 500. Moreover, a pair of the markers 44 can be stacked at the position 46 valued 500, a total of four of the markers 44 recording and displaying a player's starting point value of 1501 for the game "1501".

In each of the 301 series games, a player's game score value in one turn of the game is recorded and displayed by first dividing the score value by the scoring increment of the second array segment 64, moving one of the markers 44 from its prior position in the second array segment 64 to a new position having a lesser value by the amount of the integer result, if any. The remainder, if any, of this first division is recorded and displayed by moving that player's marker 44 within the first array segment 62 as described herein. A second division is performed, the remainder from the first division being divided by the number of columns of marker positions 46 in the rectangular array portion 68. The marker 44 is moved downwardly toward the out array portion 72 by a number of rows corresponding to the integer result of this second division, the marker 44 also being moved to the right by a number of columns corresponding to the remainder from the second division. If necessary, five column positions are "borrowed" from a row position in the first array segment 62. Also, ten row positions of the first array segment 62 are borrowed from one position of a marker 44 within the second array segment 64, if necessary. For a player to win the game, the game score value for that player's last turn must be such that the new position of the player's markers 44 is with the marker 44 in the first array segment 62 in the out array portion 72, with all of that player's markers 44 in the second array segment 64 located at the position 46 having the value of zero. In case a player's game score value in a turn is greater than that player's point value, the game score value for that turn is forfeited.

The system 10 also includes a multiples chart 80 of the possible scoring values from 1 to 20, with corresponding "doubles" values from 2 to 40, and "triples" values from 3 to 60, the chart 80 being provided on the front member 36 as shown in FIG. 3. The multiples chart 80 conveniently and inexpensively facilitates a determination of game score values in cases where a player's dart 20 hits one of the doubles subregions 22 or triples subregions 24.

In an alternative configuration of the system 10, the scoring panel 38 is divided into a pair of door panels 82, each of the panels 82 being pivotally connected to a corresponding one of the side members 30 by one or more of the hinges 40. The panels 82 are movable between an open position, extending oppositely from the side members for exposing the target 14, and a closed position covering the target 14, respective edge portions 84 of the panels 82 being proximately connected as shown by dashed lines in FIG. 5.

Figure 5:
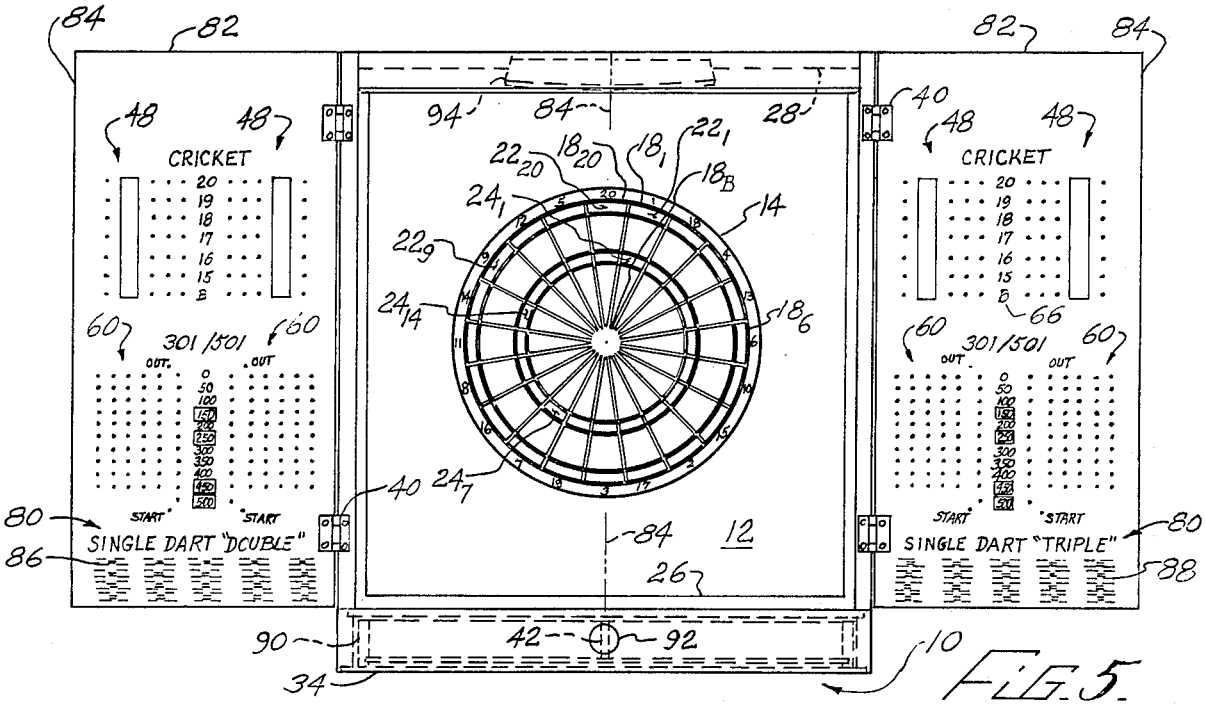
FIG. 5 is a front elevational view of an alternative configuration of the system of FIG. 1.

The marker positions 46 and the indicia 66 are exposed on the panels 82 in the open position. In this configuration, each of the door panels 82 has a pair of the cricket arrays 48, the arrays 48 of each pair sharing one complement of the indicia 66 for the respective row segments 50, only one marker position 46 being provided in each row and column of each array 48. Thus the four cricket arrays 48 shown in FIG. 5 provide scoring locations for a like number of players, whereas the same number of players are accommodated by only two of the arrays 48 in the configuration of FIG. 3.

Figure 2:
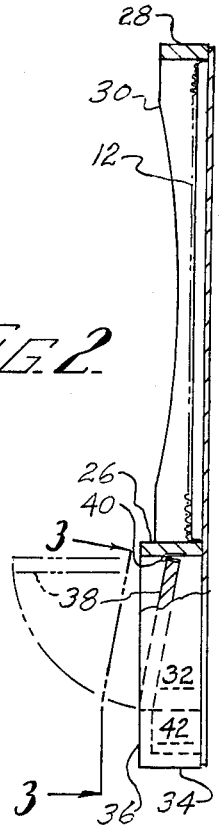
FIG. 2 is a fragmentary sectional elevational side view of the system of FIG. 1.

Each of the door panels 82 also has a pair of the modular arrays 60, a single centrally located complement of the indicia 66 being located between adjacent second array segments 64 of the arrays 60, the segments 64 each having only one column of the marker positions for use in recording game score values of one player. Thus the configuration of the apparatus 10 shown in FIG. 5 provides for recording the progress of both Cricket and 301 Series dart games with up to four players, without requiring simultaneous use of any one cricket array 48 or modular array 60 by more than one player. Another variation of the system !0 of FIG. 5 from that shown in FIGS. 1–3 is that each of the modular arrays 60 is inverted, the start array portion 70 being located below the rectangular array portion 68 (the portion 70 also having only one of the marker positions 46), the out array portion 72 being above the portion 68.

Further, a doubles portion 86 of the multiples chart 80 is provided on one of the door panels 82, a triples portion 88 of the chart 80 being provided on the other of the door panels 82. Moreover, a drawer 90 is slidably connected between the side members 30 proximate the bottom member 34, the drawer 90 functioning as the compartment 32, having a drawer pull 92 and a counterpart of the divider member 42 for storing the darts 20 separately from the markers 44. Also, the system 10 includes a clamp assembly 94 for illuminating the target 14, the lamp assembly 94 being mounted to the underside of the top number 28.

The scoring system 10 of the present invention can be inexpensively fabricated from wood or molded from plastic, the target wall 12 being lined with cork and covered with a suitable burlap material.

Although the present invention has been described in considerable detail with reference to certain preferred versions thereof, other versions are possible. Therefore, the spirit and scope of the appended claims should not necessarily be limited to the description of the preferred versions contained herein.

What is claimed is:

1. A scoring system for a dart game apparatus having a target and a plurality of darts for shooting at selected regions of the target, each of the regions having an associated scoring value for generating a corresponding game score value when a dart hits that region of the target, the system comprising:

(a) a supply of markers for use by players of the game; and (b) a scoring panel comprising:

(i) a modular pattern of marker positions on the scoring panel, the positions forming at least two distinct array segments;

(ii) a pattern of score keeping indicia on the scoring panel, each of the indicia being associated with one of the marker positions, the indicia defining a scoring increment for each of the array segments, the increments being in a fixed ratio; and (iii) means for releasably holding one or more of the markers in association with a selected marker position, wherein a player's score is indicated by the position of markers in the segments as a summation of the position of each marker in its segment multiplied by the scoring increment of that segment.

2. The system of claim 1, wherein a first array segment comprises a rectangular array portion having a first number of positions in one direction and a second number of positions in an orthogonal direction, the indicia defining the scoring increment in the one direction and the scoring increment multiplied by the first number in the orthogonal direction.

3. The system of claim 2, wherein the scoring increment of a second array segment of the marker positions is the product of the scoring increment of the first array segment, the first number of positions, and the second number of positions.

4. The system of claim 3, wherein the scoring increment of the first array segment is unity, the first number is five, the second number is ten, and the scoring increment of the second segment is fifty.

5. The system of claim 4, wherein the first array segment further comprises a starting position, the starting position having an associated indicia for a value of 51.

6. The system of claim 1, including at least two visually distinctive kinds of the markers for association with corresponding players of the game, and wherein at least one of the array segments is capable of receiving at least two of the kinds of markers in each position for permitting opponents' markers to simultaneously occupy a single position of the segment.

7. The system of claim 6, wherein the panel is formed with an opening at each marker position, and wherein each marker comprises a body portion and a stem portion for engaging a selected opening of the panel, at least some of the markers having a body cavity for receiving a stem portion of another marker whereby the markers of opposing players may be stacked.

8. The system of claim 1, wherein the apparatus provides a first game wherein a predetermined number of occurrences of at least one of the game score values is required for a player to win the game, and the indicia define for at least one of the array segments a scoring value and a required number of occurrences of the scoring value for each of the array segments.

9. The system of claim 8, wherein the target comprises a bull's-eye region and at least six other labeled regions, and the panel includes at least seven array segments, the seven array segments having associated indicia corresponding, respectively, to the bull's-eye region and each of the six labeled regions, each of the seven array segments having at least three marker positions for recording a like number of the required occurrences.

10. The system of claim 9 wherein the at least some of the target regions have at least one subregion for, the apparatus providing a second game in which a predetermined multiple of the scoring value is used as the game score value, the system further comprising a chart of the scoring value and associated game score values for each of the regions and subregions of the target.

11. The system of claim 1, further comprising:

(a) a target wall for mounting a dart board, the target wall being connected to the scoring panel; and (b) means connected to the target wall for storing the markers.

12. A scoring system for a dart game apparatus having a target and a plurality of darts for shooting at selected regions of the target, each of the regions having an associated scoring value for generating a corresponding game score value when a dart hits that region of the target, the apparatus providing a first game wherein a predetermined number of occurrences of at least one of the game score values is required for a player to win the game, the system comprising:

(a) a supply of markers for use by players of the game; and (b) a scoring panel comprising:

(i) a modular pattern of marker positions on the scoring panel, the positions forming at least one array segment;

(ii) a pattern of score keeping indicia on the scoring panel, each of the indicia being associated with at least one of the marker positions of not more than one of the array segments, the indicia defining a scoring value and a required number of occurrences of the scoring value for each of the array segments; and (iii) means for releasably holding one or more of the markers in association with a selected indicia for recording each required occurrence of a game score increment.

13. The system of claim 12, wherein the target comprises a bull's-eye region and at least six other labeled regions, and the panel includes at least seven array segments, the seven array segments having associated indicia corresponding, respectively, to the bull's-eye region and each of the six labeled regions, each of the seven array segments having at least three marker positions for recording a like number of the required occurrences.

14. A scoring system for a dart game apparatus having a target and a plurality of darts for shooting at selected regions of the target, each of the regions having an associated score value for generating a corresponding game score value when a dart hits that region of the target, the apparatus providing a first game wherein a predetermined number of occurrences of at least one of the game score values is required for a player to win the game, the system comprising:

(a) a target wall for mounting a dart board;

(b) a supply of markers, including at least two visually distinctive kinds of the markers for association with corresponding players of the game, each marker comprising a body portion and a stem portion, at least some of the markers having a body cavity for receiving a stem portion of another marker whereby the markers of opposing players may be stacked;

(c) means connected to the target wall for storing the markers; and (d) a scoring panel connected to the target wall, comprising:

(i) a modular pattern of marker positions on the scoring panel, the positions forming a plurality of array segments;

(ii) a pattern of score keeping indicia on the scoring panel, each of the indicia being associated with at least one of the marker positions of not more than one of the array segments, the indicia defining a scoring value and a required number of occurrences of the scoring value for at least one of the array segments, the indicia also defining a scoring increment for each of at least two of the array segments, the increments being in a fixed ratio; and (iii) means for releasably holding one or more of the markers in association with a selected marker position for recording each required occurrence of a game score increment, and for indicating a player's score by the position of markers in the segments having indicia defining the scoring increments, as a summation of the position of each marker in its segment multiplied by the scoring increment of that segment, comprising a hole formed in the panel at each of the positions for releasably receiving the stem portion of a marker.

* * * * *